US008821308B2

(12) United States Patent
Chiang

(10) Patent No.: US 8,821,308 B2
(45) Date of Patent: Sep. 2, 2014

(54) CLUB-SWING ALIGNMENT APPARATUS AND A FRAME THEREOF

(76) Inventor: Pin-Hui Chiang, Tokyo (JP)

( * ) Notice: Subject to any disclaimer, the term of this patent is extended or adjusted under 35 U.S.C. 154(b) by 92 days.

(21) Appl. No.: 13/607,867

(22) Filed: Sep. 10, 2012

(65) Prior Publication Data

US 2014/0038738 A1 Feb. 6, 2014

(30) Foreign Application Priority Data

Jul. 31, 2012 (TW) ..... 101127618 A

(51) Int. Cl.
*A63B 69/36* (2006.01)

(52) U.S. Cl.
USPC ..... 473/257

(58) Field of Classification Search
USPC ..... 473/257, 387–403
See application file for complete search history.

(56) References Cited

U.S. PATENT DOCUMENTS

| | | | | | |
|---|---|---|---|---|---|
| 3,347,551 | A * | 10/1967 | Dreyfus | 473/257 |
| 3,883,144 | A * | 5/1975 | Lazow | 473/218 |
| 5,437,448 | A * | 8/1995 | Balson | 473/257 |
| 6,129,639 | A * | 10/2000 | Brock et al. | 473/260 |
| 2005/0075186 | A1 | 4/2005 | Liao | |
| 2005/0233837 | A1* | 10/2005 | Jung | 473/386 |
| 2007/0238542 | A1* | 10/2007 | Pecue | 473/257 |
| 2011/0092303 | A1* | 4/2011 | Willis | 473/221 |

FOREIGN PATENT DOCUMENTS

| | | |
|---|---|---|
| TW | M247246 U | 10/2004 |
| TW | M386100 | 8/2010 |

* cited by examiner

*Primary Examiner* — Nini Legesse
(74) *Attorney, Agent, or Firm* — Alan Kamrath; Kamrath IP Lawfirm, P.A.

(57) ABSTRACT

A club-swing alignment apparatus includes a tee and a frame assembled to the tee. The tee has a positioning portion and a ball supporter. The frame includes two rails and a crossbar interconnected between the two rails. The two rails and the crossbar jointly form a reference movement path. The crossbar includes an engaging portion assembled to the ball supporter of the tee. A frame of a club-swing alignment apparatus includes two rails and a crossbar interconnected between the two rails. The crossbar has an engaging portion. The two rails and the crossbar jointly form a reference movement path.

16 Claims, 8 Drawing Sheets

CLUB-SWING ALIGNMENT APPARATUS AND A FRAME THEREOF

BACKGROUND OF THE INVENTION

1. Field of the Invention

The present invention generally relates to a club-swing alignment apparatus and a frame thereof and, more particularly, to a club-swing alignment apparatus that allows a user to see a reference movement path that the head of the club is supposed to travel along, as well as a frame thereof.

2. Description of the Related Art

Golf has long been a popular sport in modern society. When playing golf, a golf rubber tee 9 (as shown in FIG. 1) must be used to support a golf ball 8. In this regard, under the golf player's personal skill and the coach's instructions, the golf player will make fine adjustments to his/her position during the entire swing process of the golf club, trying to successfully hit the golf ball 8.

However, it requires both correct positioning and adept skills to play golf. When the player's positioning is not correct enough or the player is not skillful enough, the golf club can divert from the proper movement path that the golf club is supposed to travel along. As a result, the golf club cannot make contact with the golf ball 8 with the accuracy and force necessary to complete a successful golf swing. An improper golf swing or contact may even result in missing the golf ball 8 completely.

When playing golf, the head of the golf club is required to travel along a predetermined path during a series of continuous motions such as a "back swing", a "down swing", "the point of contact with the golf ball" and a "follow through". This must be completed in a correct fashion in order to powerfully and accurately hit the golf ball in the desired direction. In light of this, Taiwan Patent Nos. I223603, M247246 and M386100 disclose a variety of golf practice apparatuses that can be used by a golf beginner to practice swinging the golf club with the correct positioning as well as practice hitting the golf balls.

During the use of the conventional golf practice apparatus mentioned above, golf beginners still need someone to adjust their positioning. It can be difficult for golf beginners to adjust their position without a coach or expert on hand to help them. This can result in frustration in the learning process of a golf swing. In addition, if said apparatus is not properly used, the users' position is not effectively adjusted. In a worse case scenario, golf beginners may even be injured due to incorrect positioning.

In light of this, it is necessary to provide a club-swing alignment apparatus that allows a user to see a reference movement path that the head of the golf club is supposed to travel along, to improve the accuracy in hitting the ball. This helps the beginners with the learning process when playing the sport of golf without encountering the above mentioned problems.

SUMMARY OF THE INVENTION

It is therefore the objective of this invention to provide a club-swing alignment apparatus which allows a user to see a reference movement path that the head of the club is supposed to travel along. The user is required to swing the club in a manner where the head of the club travels along the reference movement path, thereby correcting the user's position and improving the user's skill. As such, the club can hit the ball with sufficient force and improved accuracy.

It is another objective of this invention to provide a club-swing alignment apparatus that can be used by a user to practice swinging the club and to adjust his/her position without someone on hand to help them, thus reducing the potential of injury resulting from incorrect positioning.

In an embodiment, a club-swing alignment apparatus comprises a tee and a frame. The tee has a positioning portion and a ball supporter. The frame is assembled to the tee. The frame comprises two rails and a crossbar interconnected between the two rails. The two rails and the crossbar jointly form a reference movement path. The crossbar comprises an engaging portion assembled to the ball supporter of the tee.

In a preferred form shown, the crossbar comprises two surfaces and two lateral sides. A guiding portion is positioned on one of the two surfaces and adjacent to one of the two lateral sides of the crossbar. The guiding portion is an instructional mark in the form of a reference line perpendicular to the reference movement path.

In the preferred form shown, the guiding portion is an inclined face extending from one of the two surfaces to one of the two lateral sides in an inclined manner. Alternatively, the guiding portion is an inclined face extending from one of the two surfaces to the other one of the two surfaces in an inclined manner.

In the preferred form shown, the engaging portion is positioned at a center of the crossbar. The engaging portion is in the form of a through-hole. The crossbar is fitted around the ball supporter via the through-hole. Alternatively, the engaging portion is in the form of a C-shaped notch having a pair of fasteners. The pair of fasteners is engaged with the ball supporter to couple the tee and the frame with each other.

In the preferred form shown, the frame is spaced from the positioning portion of the tee by a distance.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
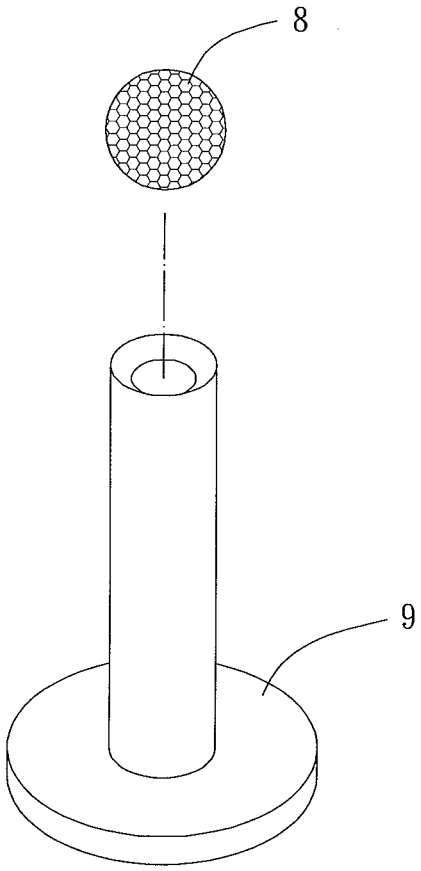
FIG. 1 PRIOR ART
FIG. 1 shows a golf rubber tee and a golf ball.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

A club-swing alignment apparatus and a frame thereof are disclosed according to a preferred embodiment of the invention. The club-swing alignment apparatus can be used in sports where users are required to swing a club along a predetermined path to properly hit a ball, such as golf, croquet, etc. Based on the club-swing alignment apparatus, the users are able to see the path along which the club head is supposed to travel, thereby allowing the users to swing the golf club in a correct pattern. In this embodiment, golf is exemplarily used as the sport for illustration of the invention, as elaborated below.

Figure 2:
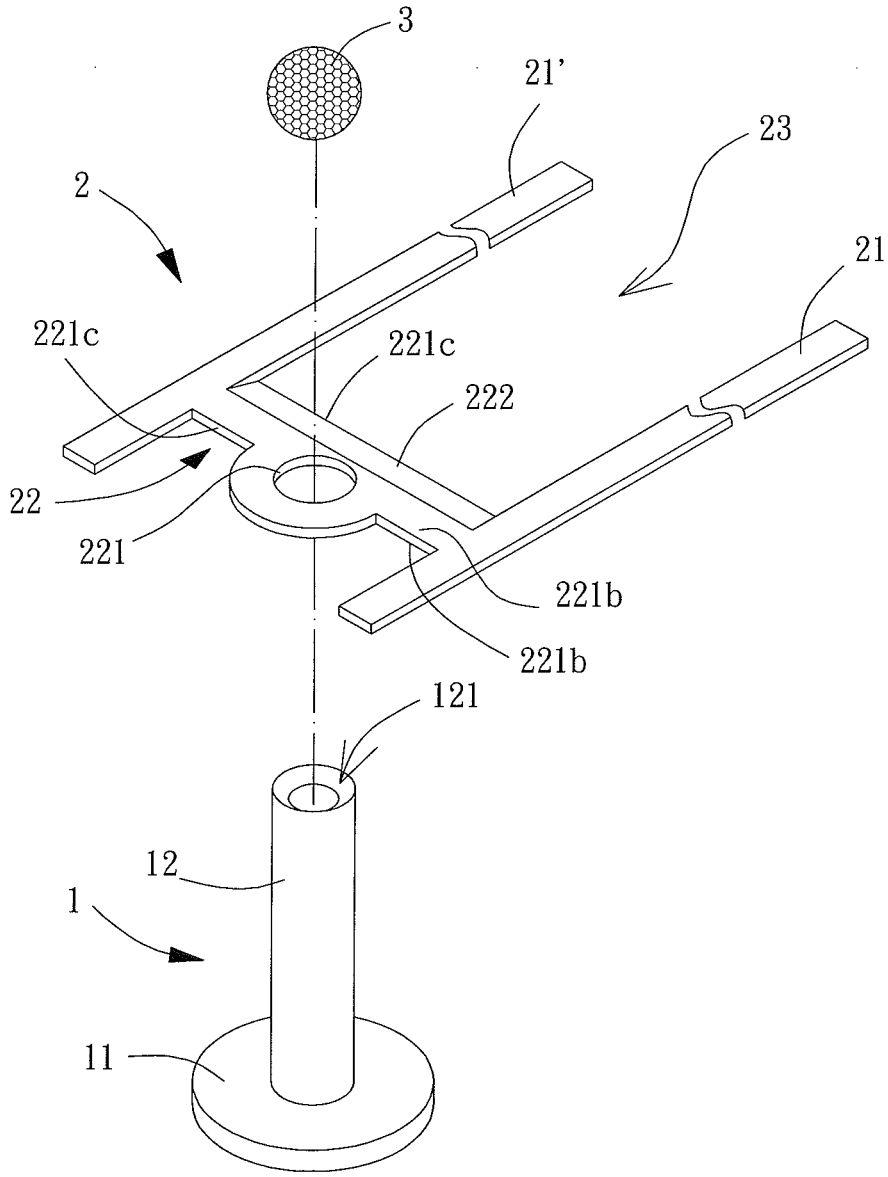
FIG. 2 is an exploded view of a club-swing alignment apparatus according to a preferred embodiment of the invention.

Referring to FIG. 2, the club-swing alignment apparatus includes a tee 1 and a frame 2 assembled to the tee 1.

The tee 1 is a rubber tee that is commonly used to support a ball 3. The tee 1 has a positioning portion 11 and a ball supporter 12. The tee 1 is positioned by the positioning portion 11. The ball supporter 12 is adapted to support the ball 3. The tee 1 may be in the form of a shaft having a first end and a second end. The ball supporter 12 may be positioned at the first end of the shaft, and the positioning portion 11 may be positioned at the second end of the shaft. The positioning portion 11 may be positioned on the ground to prevent undesired shift of the tee 1. Alternatively, the positioning portion 11 of the tee 1 may include a base, and the ball supporter 12 may be in the form of a shaft. The shaft may be integrally formed with the base. Alternatively, the shaft may also be coupled with the base by way of adhesion, press fit or the like. Specifically, the shaft is in the form of a tube made of elastic material such as rubber, plastic or the like, to reduce the impact acted upon the ball supporter 12 when the head 4 of the golf club hits the ball supporter 12. This also prevents damage to the golf club resulting from the golf club hitting rigid material.

In this embodiment, a ball recess 121 is formed on the top of the ball supporter 12 (shaft) for receiving the ball 3. The ball recess 121 has an inclined bottom face as shown in FIG. 2. The inclined bottom face provides a ball-guiding function which allows the ball 3 to be smoothly hit out of the ball recess 121 at the moment the golf club hits the ball 3.

Figure 3:
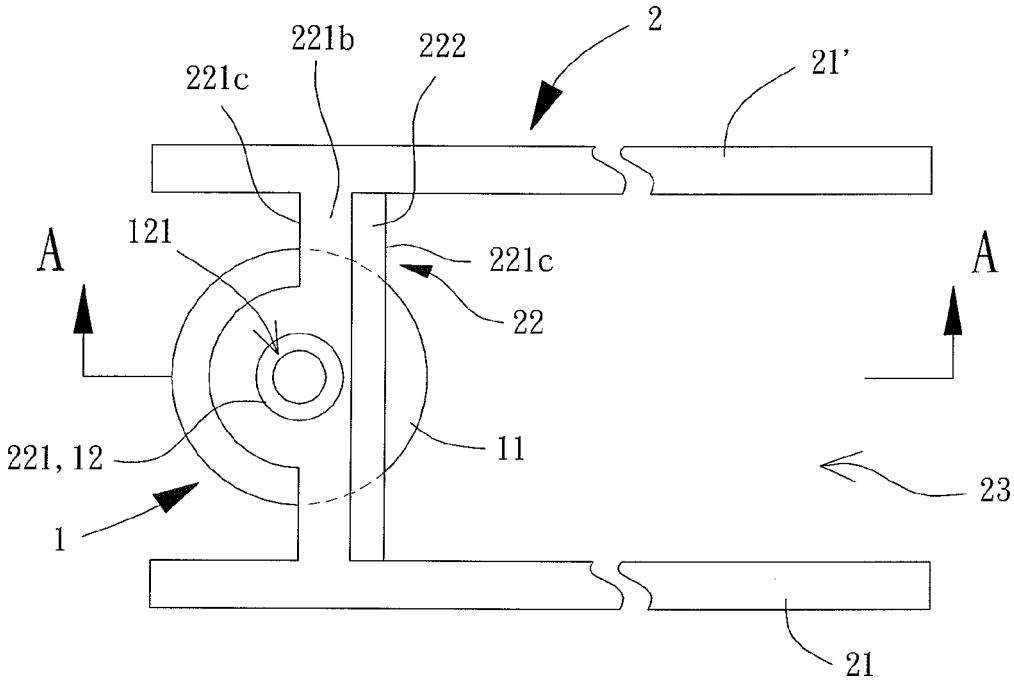
FIG. 3 is a top view of the club-swing alignment apparatus of the preferred embodiment of the invention.

Referring to FIGS. 2 and 3 again, the frame 2 has two rails 21 and 21' and a crossbar 22 interconnected between the rails 21 and 21'. The rails 21 and 21' and the crossbar 22 jointly form a reference movement path 23. The crossbar 22 and the rails 21 and 21' may be integrally formed with each other as the shape of "U", "∩" or "H". However, the crossbar 22 and the rails 21 and 21' are not limited to the above shapes as long as said components can form the reference movement path 23. The crossbar 22 and the rails 21 and 21' may also be coupled with each other by way of welding, adhesion or the like. In the embodiment, the rails 21 and 21' are preferably parallel to each other to ensure that the head 4 of the golf club moves along the reference movement path 23 when the player swings the golf club. Based on this, the ball 3 may be hit in a desired direction. In addition, the head 4 of the golf club has a contact face, and the distance between the rails 21 and 21' is equal to a maximal width of the contact face (the golf club as shown in the drawing is a wooden club). The rails 21 and 21' and the crossbar 22 are integrally formed with each other as the shape of an "H" in this embodiment.

The lengths of the rails 21 and 21' can be changed based on the ability of the players. The lengths of the rails 21 and 21' are not limited to any values as long as said rails 21 and 21' can form the reference movement path 23 when coupled with the crossbar 22.

Figure 4:
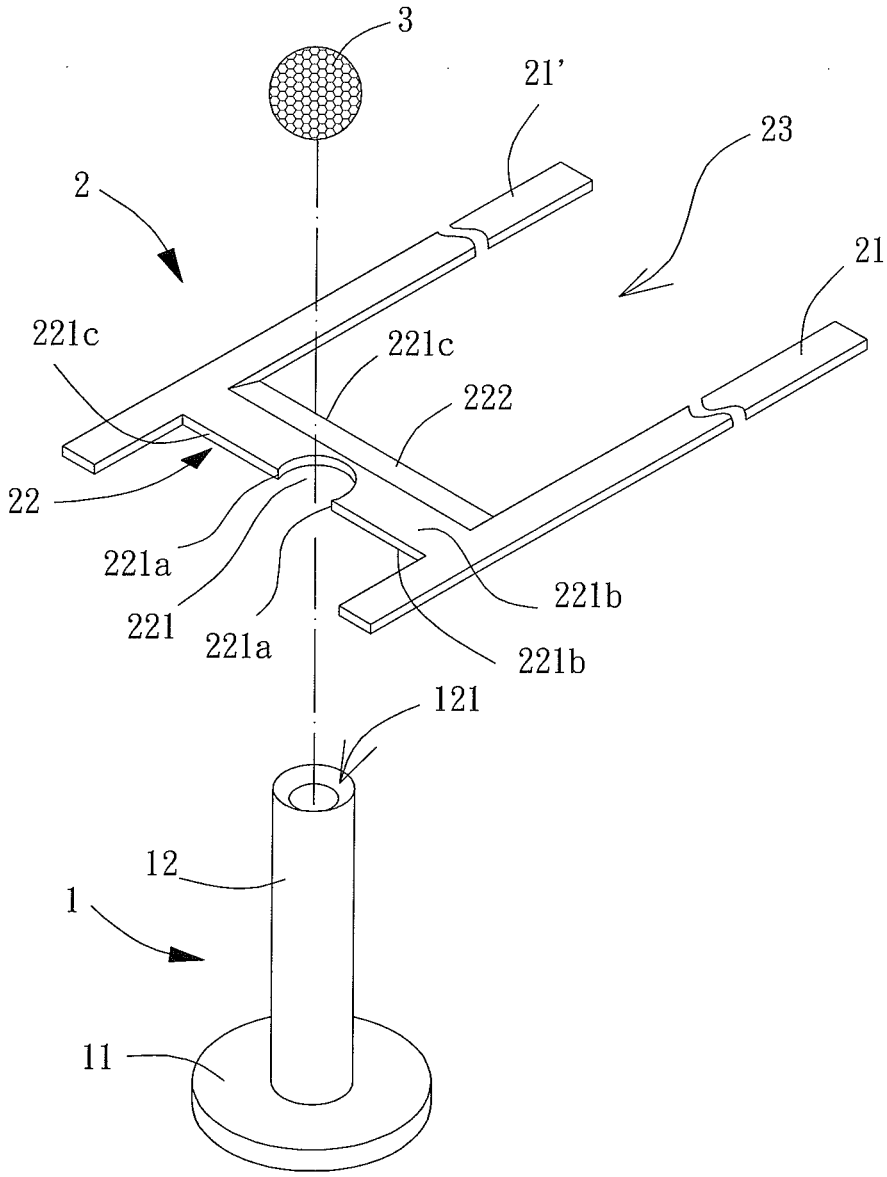
FIG. 4 is an exploded view of a modified club-swing alignment apparatus according to the preferred embodiment of the invention.
Figure 5:
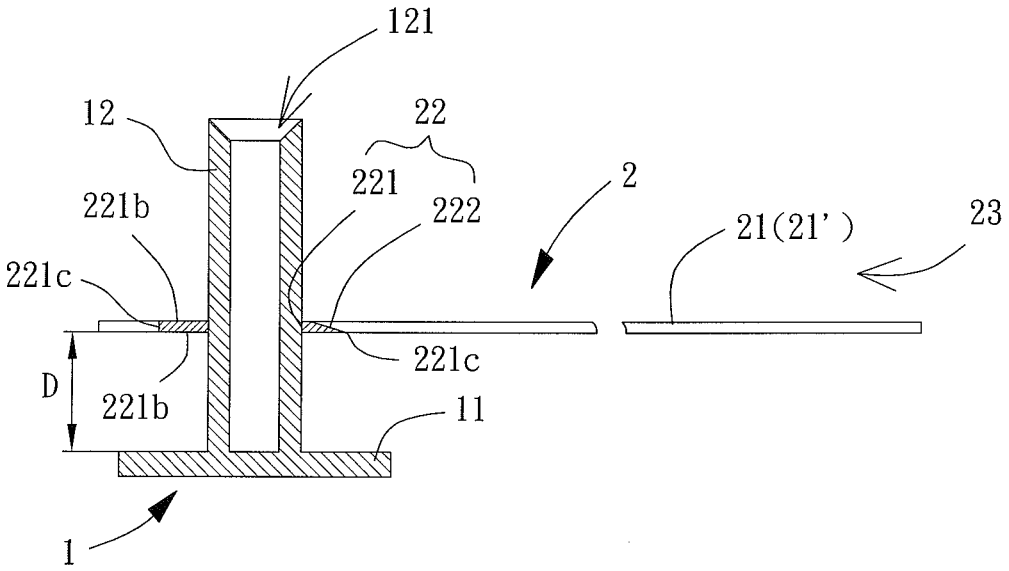
FIG. 5 is a cross-sectional view of the club-swing alignment apparatus of the preferred embodiment of the invention taken along line "A-A" shown in FIG. 3.

The crossbar 22 has an engaging portion 221 at a center thereof. The engaging portion 221 may be in the form of a through-hole. The crossbar 22 may be fitted around the ball supporter 12 via the engaging portion 221 by press fitting, screwing, fastening or the like. Alternatively, the engaging portion 221 may be a C-shaped notch having a pair of fasteners 221*a*, as shown in FIG. 4. The pair of fasteners 221*a* may be engaged with the ball supporter 12 to couple the tee 1 and the frame 2 together. However, the engaging portion 221 is not limited to the above structures. The engaging portion 221 may have other implementations that allow mutual assembly between the tee 1 and the frame 2. Furthermore, the frame 2 may be placed on artificial grass when the engaging portion 221 is fitted around the ball supporter 12. Alternatively, as shown in FIG. 5, the frame 2 is preferably spaced from the positioning portion 11 of the tee 1 by a distance D. This ensures that the head 4 of the golf club is spaced from the ground by the distance D, preventing the head 4 of the golf club from making contact with the ground when the player swings the golf club. The distance D is preferably about 1.2 cm to 1.5 cm.

Figure 6:
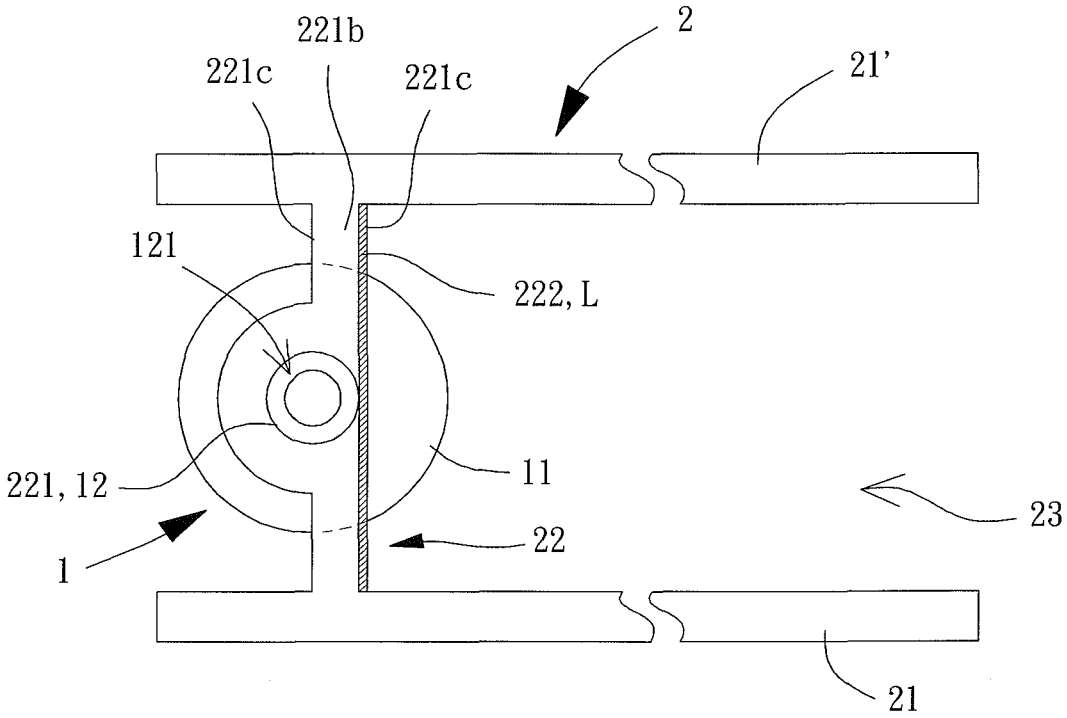
FIG. 6 is a top view of another modified club-swing alignment apparatus according to the preferred embodiment of the invention.

Referring to FIG. 2 again, the crossbar 22 includes two surfaces 221*b* and two lateral sides 221*c*. A guiding portion 222 is positioned on one of the surfaces 221*b* and is adjacent to one of the lateral sides 221*c* of the crossbar 22. Based on the arrangement of the guiding portion 222, the player is able to recognize the timing that is needed when he/she should transfer their weight in order to begin the follow through stage of their swing to make proper contact between the head 4 and the ball 3 and to achieve an accurate and powerful shot. However, the guiding portion 222 will allow for two separate options. The first option will include an instructional mark drawn on the crossbar 22. The second option is a physical structure formed on the crossbar 22 that will show an incline to signify when to begin the weight transfer needed to apply a proper follow through (i.e. when to begin raising the club head) (both cases will be described below). Specifically, in the first option, the guiding portion 222 may be an instructional mark that is in the form of a reference line L perpendicular to the reference movement path 23, as shown in FIG. 6. The player is able to judge when he/she needs to transfer their weight in order to raise the golf club by the position of the instructional mark. In the second option shown in FIG. 2, the guiding portion 222 may be an inclined face formed on one of the two surfaces 221*b* and adjacent to one of the two lateral sides 221*c* of the crossbar 22. The inclined face extends from one surface 221*b* to one lateral side 221*c* in an inclined manner. Alternatively, the inclined face may extend from one surface 221*b* to the other surface 221*b* in an inclined manner. Based on the inclined face, the player is able to recognize the proper time when he/she needs to begin the follow through to have the club head properly make contact with the ball 3. The inclined face is able to reduce the impact resulting from the golf club unintentionally hitting the crossbar 22.

Figure 7:
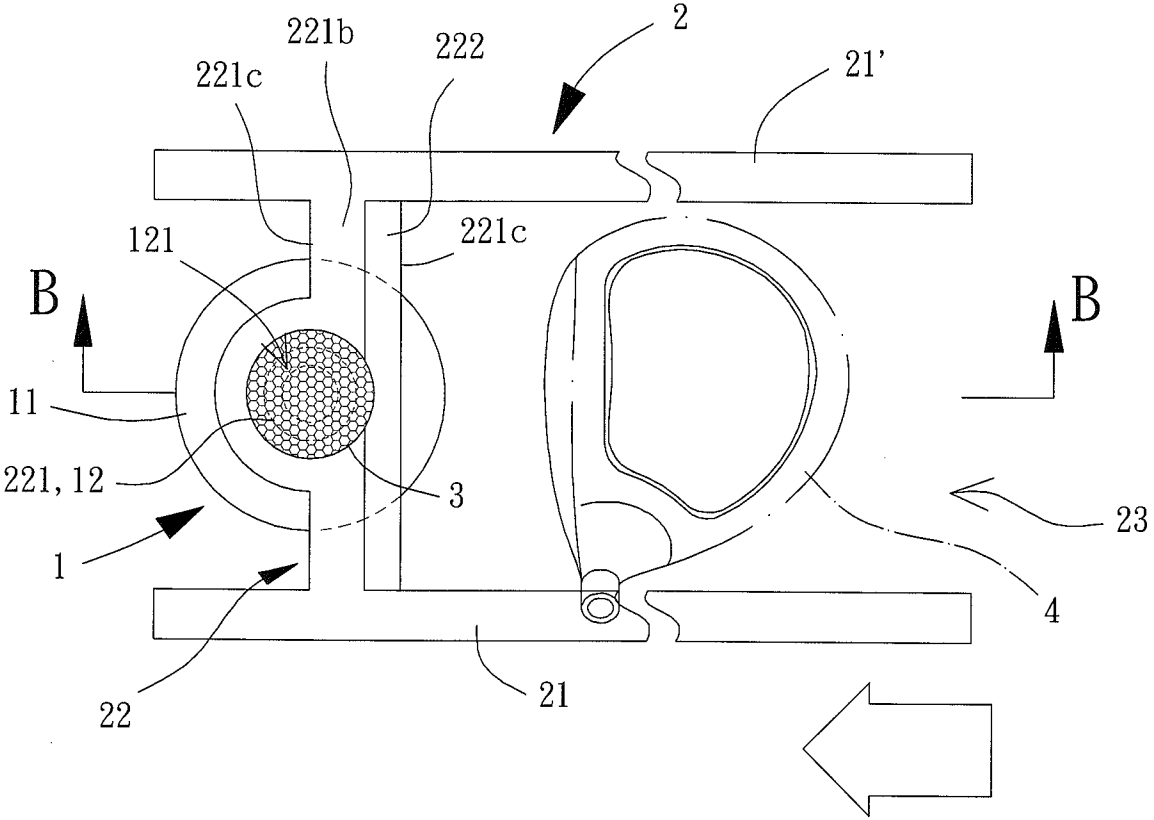
FIG. 7 shows a use of the club-swing alignment apparatus with the club head in a stationary state ready to hit the ball.
Figure 8:
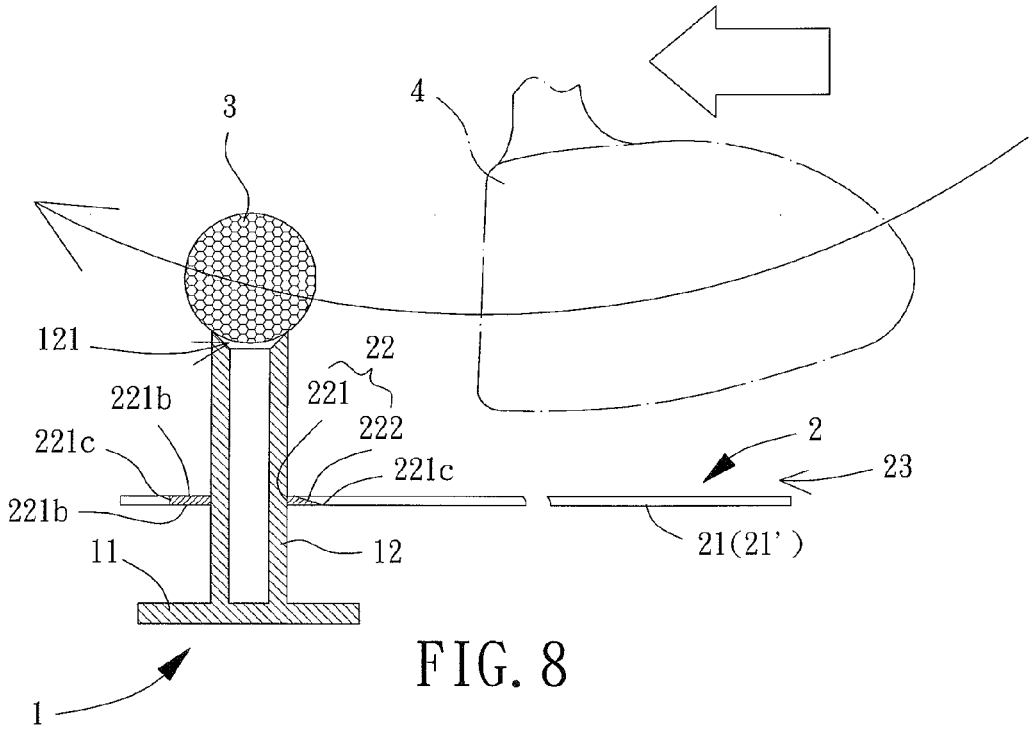
FIG. 8 is a cross-sectional view of the club-swing alignment apparatus taken long line "B-B" shown in FIG. 7.
Figure 9:
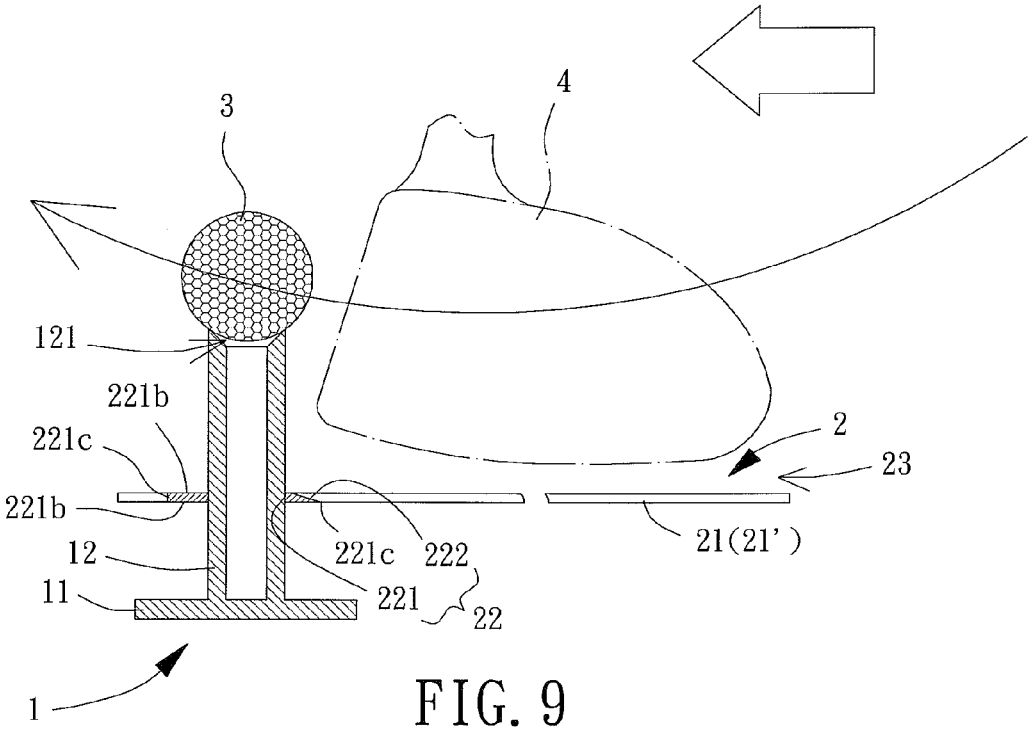
FIG. 9 shows the use of the club-swing alignment apparatus with the club head starting to move towards the ball.

Referring to FIGS. 5 and 6, when the club-swing alignment apparatus is in use, the player is required to place the ball 3 on the ball recess 121. The player is then required to grasp the golf club in a manner where the head 4 of the golf club is positioned in the reference movement path 23 above the frame 2 (as shown in FIGS. 5 and 7). Based on this, as shown in FIG. 8, the player may swing the golf club in a direction indicated by the arrow within the extent of the reference movement path 23, ensuring that the head 4 of the golf club travels along the reference movement path 23 without diverting from the extent of the reference movement path 23. At this time, when the head 4 of the golf club is approaching the guiding portion 222, the player can raise the golf club before the guiding portion 222. In this manner, the contact face of the head 4 may face and move towards the ball 3 in a direction as indicated by the lower arrow shown in FIG. 9, hitting the ball 3 out of the ball recess 121.

In conclusion, the club-swing alignment apparatus allows the player to see the expected movement path of the head 4 by the arrangement of the reference movement path 23. Therefore, the player is able to swing the golf club along a correct path by ensuring that the head 4 of the golf club moves within the extent of the reference movement path 23. Advantageously, the club-swing alignment apparatus is able to prevent golf beginners from swinging the golf club in an incorrect path due to the lack of experience. Consequently, the head 4 of the golf club may hit the ball 3 with sufficient force, improving the accuracy in hitting the ball 3. Moreover, since the frame 2 can be easily assembled to the tee 1, the golf beginners are able to use the club-swing alignment apparatus by themselves without someone on hand to help them. Golf beginners are also able to adjust the frame 2 in a proper position that fits to their figures, improving the gesture accuracy and reducing the potential of injury resulting from incorrect positioning.a12

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A club-swing alignment apparatus comprising:

a tee having a positioning portion and a ball supporter; and a frame assembled to the tee, wherein the frame comprises two rails and a crossbar interconnected between the two rails, wherein the two rails and the crossbar jointly form a reference movement path, wherein the crossbar comprises an engaging portion assembled to the ball supporter of the tee, wherein the positioning portion of the tee includes a base, wherein the ball supporter is in the form of a shaft, wherein the shaft is arranged on the base, and wherein the shaft is in the form of a tube made of rubber or plastic.

2. The club-swing alignment apparatus as claimed in claim 1, wherein the crossbar comprises two surfaces and two lateral sides, wherein a guiding portion is positioned on one of the two surfaces and adjacent to one of the two lateral sides of the crossbar, and wherein the guiding portion is in the form of a reference line perpendicular to the reference movement path.

3. The club-swing alignment apparatus as claimed in claim 1, wherein the crossbar comprises two surfaces and two lateral sides, wherein a guiding portion is formed on one of the two surfaces and adjacent to one of the two lateral sides of the crossbar, and wherein the guiding portion is an inclined face extending from the one of the two surfaces to the one of the two lateral sides in an inclined manner.

4. The club-swing alignment apparatus as claimed in claim 1, wherein the crossbar comprises two surfaces, wherein a guiding portion is formed on the crossbar, and wherein the guiding portion is an inclined face extending from one of the two surfaces to an other one of the two surfaces in an inclined manner.

5. The club-swing alignment apparatus as claimed in claim 1, wherein the engaging portion is positioned at a center of the crossbar, wherein the engaging portion is in the form of a through-hole, and wherein the crossbar is fitted around the ball supporter via the through-hole.

6. The club-swing alignment apparatus as claimed in claim 1, wherein the engaging portion is positioned at a center of the crossbar, wherein the engaging portion is in the form of a C-shaped notch having a pair of fasteners, and wherein the pair of fasteners is engaged with the ball supporter to couple the tee and the frame with each other.

7. The club-swing alignment apparatus as claimed in claim 1, wherein the frame is spaced from the positioning portion of the tee.

8. The club-swing alignment apparatus as claimed in claim 1, wherein a ball recess is formed on a top of the ball supporter, and wherein the ball recess has an inclined bottom face.

9. The frame of the club-swing alignment apparatus as claimed in claim 1, wherein the engaging portion is positioned at a center of the crossbar, and wherein the engaging portion is in the form of a through-hole.

10. The frame of the club-swing alignment apparatus as claimed in claim 1, wherein the engaging portion is positioned at a center of the crossbar, and wherein the engaging portion is in the form of a C-shaped notch.

11. A frame of a club-swing alignment apparatus comprising:

two rails; and a crossbar interconnected between the two rails and having an engaging portion, wherein the two rails and the crossbar jointly form a reference movement path, wherein the crossbar comprises two surfaces and two lateral sides, wherein a guiding portion is formed on one of the two surfaces and adjacent to one of the two lateral sides of the crossbar, and wherein the guiding portion is an inclined face extending from the one of the two surfaces to the one of the two lateral sides in an inclined manner.

12. The frame of the club-swing alignment apparatus as claimed in claim 11, wherein the engaging portion is positioned at a center of the crossbar, and wherein the engaging portion is in the form of a through-hole.

13. The frame of the club-swing alignment apparatus as claimed in claim 11, wherein the engaging portion is positioned at a center of the crossbar, and wherein the engaging portion is in the form of a C-shaped notch.

14. A frame of a club-swing alignment apparatus comprising:

two rails; and a crossbar interconnected between the two rails and having an engaging portion, wherein the two rails and the crossbar jointly form a reference movement path, wherein the crossbar comprises two surfaces, wherein a guiding portion is formed on the crossbar, and wherein the guiding portion is an inclined face extending from one of the two surfaces to an other one of the two surfaces in an inclined manner.

15. The frame of the club-swing alignment apparatus as claimed in claim 14, wherein the engaging portion is positioned at a center of the crossbar, and wherein the engaging portion is in the form of a through-hole.

16. The frame of the club-swing alignment apparatus as claimed in claim 14, wherein the engaging portion is positioned at a center of the crossbar, and wherein the engaging portion is in the form of a C-shaped notch.

* * * * *